US010672358B2

(12) United States Patent
Matsumoto

(10) Patent No.: US 10,672,358 B2
(45) Date of Patent: Jun. 2, 2020

(54) DRIVING CIRCUIT WITH FILTERING FUNCTION AND DISPLAY DEVICE HAVING THE SAME

(71) Applicant: Samsung Display Co., Ltd., Yongin-Si, Gyeonggi-Do (KR)

(72) Inventor: Kazuhiro Matsumoto, Yokohama (JP)

(73) Assignee: Samsung Display Co., Ltd. (KR)

( * ) Notice: Subject to any disclaimer, the term of this patent is extended or adjusted under 35 U.S.C. 154(b) by 125 days.

(21) Appl. No.: 15/952,480

(22) Filed: Apr. 13, 2018

(65) Prior Publication Data

US 2019/0088227 A1 Mar. 21, 2019

(30) Foreign Application Priority Data

Sep. 21, 2017 (KR) ..... 10-2017-0122060

(51) Int. Cl.
*G09G 3/36* (2006.01)

(52) U.S. Cl.
CPC ... *G09G 3/3685* (2013.01); *G09G 2310/0286* (2013.01); *G09G 2310/0291* (2013.01); *G09G 2310/0294* (2013.01); *G09G 2310/0297* (2013.01); *G09G 2320/02* (2013.01)

(58) Field of Classification Search
CPC ... G09G 2310/0286; G09G 2310/0291; G09G 2310/0294; G09G 2310/0297; G09G 2320/02; G09G 3/3685
See application file for complete search history.

(56) References Cited

U.S. PATENT DOCUMENTS 7,450,096 B2 * 11/2008 Kwon ..... G09G 3/2092 345/100
8,860,738 B2 * 10/2014 Endo ..... G09G 3/20 345/522
2008/0024473 A1 * 1/2008 Hsu ..... G09G 3/3648 345/204
2009/0015531 A1 * 1/2009 Tsai ..... G09G 3/3611 345/89
2015/0243199 A1 * 8/2015 Lee ..... G09G 3/3648 345/691

FOREIGN PATENT DOCUMENTS

JP H06-138838 A 5/1994
KR 10-0575443 A 4/2006
KR 10-1611165 A 4/2016
WO 2012-029915 A1 3/2012

* cited by examiner

*Primary Examiner* — Kenneth Bukowski
(74) *Attorney, Agent, or Firm* — Innovation Counsel LLP

(57) ABSTRACT

A driving circuit of a display device includes first and second line buffers, first and second output circuits, and a filtering process circuit. The first line buffer stores a first present data signal and outputs a first previous line data signal, and the second line buffer stores a second present data signal and outputs a second previous line data signal. The filtering process circuit alternately outputs the present data signal as one of the first present data signal and the second present data signal, and outputs a first filtered data signal and a second filtered data signal. The first output circuit receives the first filtered data signal and drives a first data line group of a plurality of data lines, and the second output circuit receives the second filtered data signal and drives a second data line group of the data lines.

20 Claims, 5 Drawing Sheets

DRIVING CIRCUIT WITH FILTERING FUNCTION AND DISPLAY DEVICE HAVING THE SAME

This U.S. non-provisional patent application claims priority under 35 U.S.C. § 119 to Korean Patent Application No. 10-2017-0122060, filed on Sep. 21, 2017, the contents of which are hereby incorporated by reference in its entirety.

BACKGROUND

1. Field

The present disclosure relates to a driving circuit that drives a data line and a display device having the driving circuit.

2. Description of the Related Art

In general, a display device includes a display panel to display an image and a driving circuit to drive the display panel. The display panel includes a plurality of gate lines, a plurality of data lines, and a plurality of pixels. Each pixel includes a switching transistor and a liquid crystal capacitor.

The display device applies a gate-on voltage to a gate electrode of the switching transistor connected to a pixel where the image is displayed through a corresponding gate line and applies a data signal corresponding to the image to a source electrode of the switching transistor, to thereby display the image.

A filtering process is required to be performed on an image signal, which is to be applied to the data lines, in order to improve the quality of the image displayed through the display panel.

SUMMARY

The present disclosure provides a driving circuit having a filtering function.

The present disclosure provides a display device including the driving circuit having the filtering function.

Embodiments of the inventive concept provide a driving circuit including a first line buffer that stores a first present data signal and outputs a first previous line data signal, a second line buffer that stores a second present data signal and outputs a second previous line data signal, a filtering process circuit that receives a present data signal, alternately outputs the present data signal as one of the first present data signal and the second present data signal, and outputs a first filtered data signal and a second filtered data signal based on the present data signal, the first previous line data signal, and the second previous line data signal, a first output circuit that receives the first filtered data signal and drives a first data line group of a plurality of data lines, and a second output circuit that receives the second filtered data signal and drives a second data line group of the data lines.

The first line buffer and the first output circuit are arranged in a first area, the second line buffer and the second output circuit are arranged in a second area, and the filtering process circuit is arranged in a third area disposed between the first area and the second area.

The filtering process circuit includes a first selection circuit that applies the present data signal corresponding to an odd-numbered data line to the first output circuit as the first present data signal and applies the present data signal corresponding to an even-numbered data line to the second output circuit as the second present data signal.

The first line buffer includes a first shift circuit that stores the first present data signal and outputs the first previous line data signal and a third shift circuit that stores the first previous line data signal and outputs a third previous line data signal.

Each of the first and third shift circuits includes a first-in/first-out shift register.

The second line buffer includes a second shift circuit that stores the second present data and outputs the second previous line data signal and a fourth shift circuit that stores the second previous line data signal and outputs a fourth previous line data signal.

Each of the second and fourth shift circuits includes a first-in/first-out shift register.

The filtering process circuit further includes a first buffer that stores a filtering coefficient, a second buffer that stores the present data signal and the first to fourth previous line data signals, a calculation and control circuit that performs a convolution calculation on the filtering coefficient from the first buffer and data signals from the second buffer, and outputs a filtered data signal, and a second selection circuit that applies the filtered data signal corresponding to the odd-numbered data line to the first output circuit as the first filtered data signal and applies the filtered data signal corresponding to the even-numbered data line to the second output circuit as the second filtered data signal.

The first output circuit includes a first shift register that receives the first filtered data signal and outputs shift data signal, a first latch circuit that outputs the shift data signal as a latch data signal in response to a load signal, a first digital-to-analog converter that converts the latch data signal from the first latch circuit to analog image signal, and a first output buffer that outputs the analog image signal to the first data line group in synchronization with the load signal.

The second output circuit includes a second shift register that receives the second filtered data signal and outputs shift data signal, a second latch circuit that outputs the shift data signal as a latch data signal in response a load signal, a second digital-to-analog converter that converts the latch data signal from the second latch circuit to analog image signal, and a second output buffer that outputs the analog image signal to the second data line group in response to the load signal.

Embodiments of the inventive concept provide a display device including a display panel that includes a plurality of pixels respectively connected to a plurality of gate lines and to a plurality of data lines, a gate driving circuit that drives the gate lines, a data driving circuit that drives the data lines, and a driving controller that controls the gate driving circuit and the data driving circuit in response to a control signal and an image input signal provided from an external source and outputs a present data signal corresponding to the image input signal and a horizontal synchronization signal. The data driving circuit includes a filtering process circuit that receives the present data signal, alternately outputs the present data signal as one of a first present data signal and a second present data signal, and outputs a first filtered data signal and a second filtered data signal on the basis of the present data signal, a first previous line data signal, and a second previous line data signal, a first driving circuit that receives the first present data signal and the first filtered data signal, outputs the first previous line data signal, and drives a first data line group of the data lines, and a second driving circuit that receives the second present data signal and the second filtered data signal, outputs the second previous line data signal, and drives a second data line group of the data lines.

The first driving circuit includes a first line buffer that stores the first present data signal and outputs the first previous line data signal and a first output circuit that receives the first filtered data signal and drives the first data line group.

The first line buffer includes a first shift circuit that stores the first present data signal and outputs the first previous line data signal and a third shift circuit that stores the first previous line data signal and outputs a third previous line data signal.

The second driving circuit includes a second line buffer that stores the second present data signal and outputs the second previous line data signal and a second output circuit that receives the second filtered data signal and drives the second data line group.

The second line buffer includes a second shift circuit that stores the second present data signal and outputs the second previous line data signal and a fourth shift circuit that stores the second previous line data signal and outputs a fourth previous line data signal.

The filtering process circuit includes a first buffer that stores a filtering coefficient, a second buffer that stores the present data signal and the first to fourth previous line data signals, a calculation and control circuit that performs a convolution calculation on the filtering coefficient from the first buffer and data signals from the second buffer, and outputs a filtered data signal, and a second selection circuit that applies the filtered data signal corresponding to an odd-numbered data line to the first output circuit as the first filtered data signal and applies the filtered data signal corresponding to an even-numbered data line to the second output circuit as the second filtered data signal.

The second output circuit includes a second shift register that receives the second filtered data signal and outputs shift data signal, a second latch circuit that outputs the shift data signal as a latch data signal in response to a load signal, a second digital-to-analog converter that converts the latch data signal from the second latch circuit to analog image signal, and a second output buffer that outputs the analog image signal to the second data line group in response to the load signal.

The first output circuit includes a first shift register that receives the first filtered data signal and outputs shift data signal, a first latch circuit that outputs the shift data signal as a latch data signal in synchronization with a load signal, a first digital-to-analog converter that converts the latch data signal from the first latch circuit to analog image signal, and a first output buffer that outputs the analog image signal to the first data line group in response to the load signal.

Embodiments of the inventive concept provide a driving circuit including a first shift circuit that stores a first present data signal and outputs a first previous line data signal, a second shift circuit that stores a second present data signal and outputs a second previous line data signal, a third shift circuit that stores the first previous line data signal and outputs a third previous line data signal, a fourth shift circuit that stores the second previous line data signal and outputs a fourth previous line data signal, a filtering process circuit that receives a present data signal, alternately outputs the present data signal as one of the first present data signal and the second present data signal, and outputs a first filtered data signal and a second filtered data signal on the basis of the present data signal and the first to fourth previous line data signals a first output circuit that receives the first filtered data signal and drives a first data line group of a plurality of data lines, and a second output circuit that receives the second filtered data signal and drives a second data line group of the data lines.

The filtering process circuit further includes a first buffer that stores a filtering coefficient, a second buffer that stores the present data signal and the first to fourth previous line data signals, a calculation and control circuit that performs a convolution calculation on the filtering coefficient from the first buffer, and data signals from the second buffer, and outputs a filtered data signal, and a second selection circuit that applies the filtered data signal corresponding to an odd-numbered data line to the first output circuit as the first filtered data signal and applies the filtered data signal corresponding to an even-numbered data line to the second output circuit as the second filtered data signal.

According to the above, the driving circuit includes the filtering process circuit that carries out a filtering process on the image signal provided to the data lines. Since the line buffer, which is required for the filtering process circuit, is included in the driving circuit after the size of the line buffer is minimized, the increase in area of the driving circuit is reduced. Moreover, the quality of the image displayed through the display panel is improved by the filtering process on the image signal.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
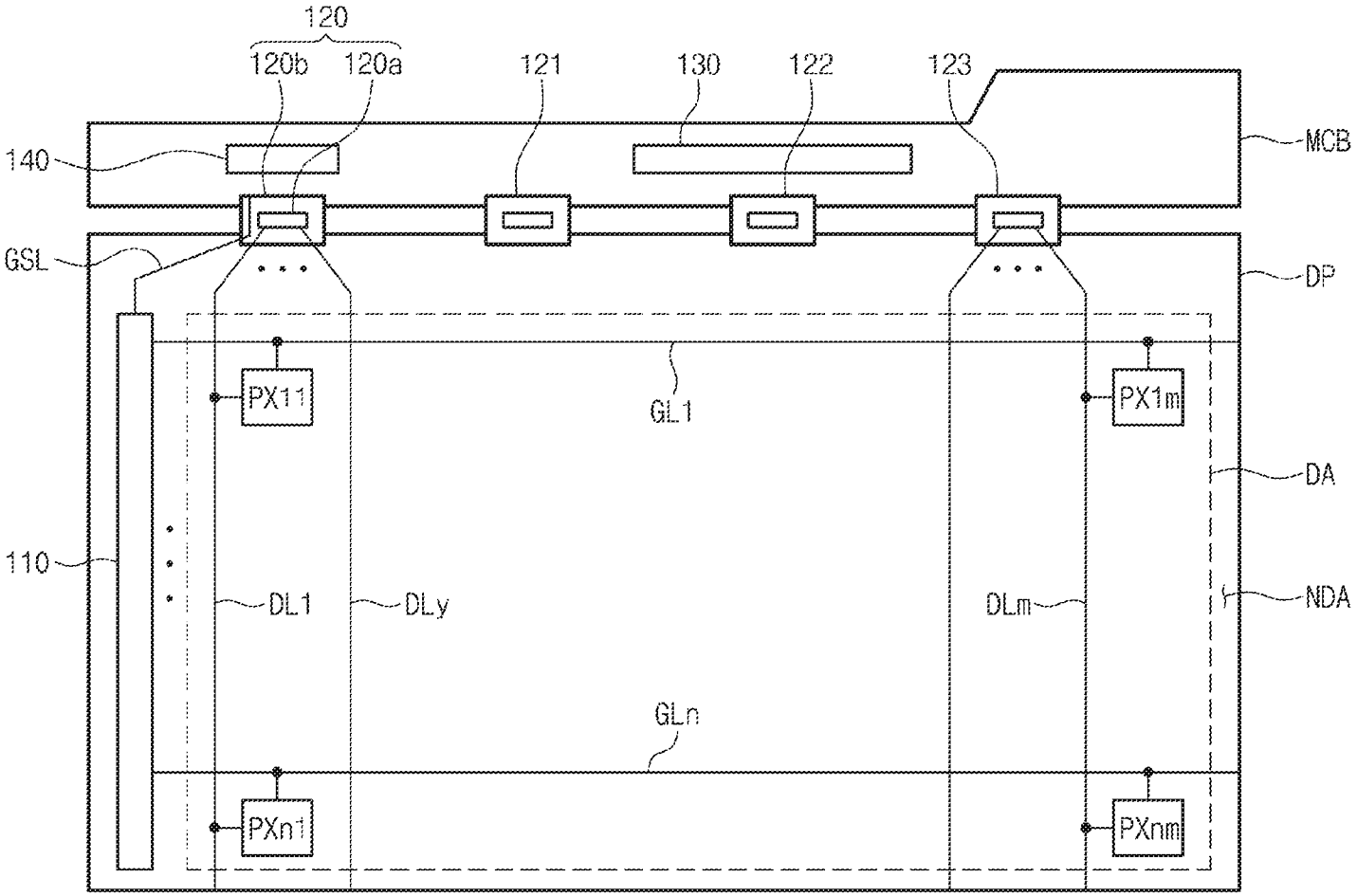
FIG. 1 is a plan view showing a display device according to an exemplary embodiment of the present disclosure.

In the following descriptions, the same reference numerals are used to denote parts, components, blocks, circuits, units, or modules, which have the same or similar functions as each other, over two or more drawings. However, this usage is for simplicity of explanation and ease of discussion only and does not imply that the configurations or structural details of the components or units are the same in all embodiments. Also, the commonly referenced parts/modules should not be taken as the only way to implement the teachings of the specific embodiments disclosed herein.

Figure 2:
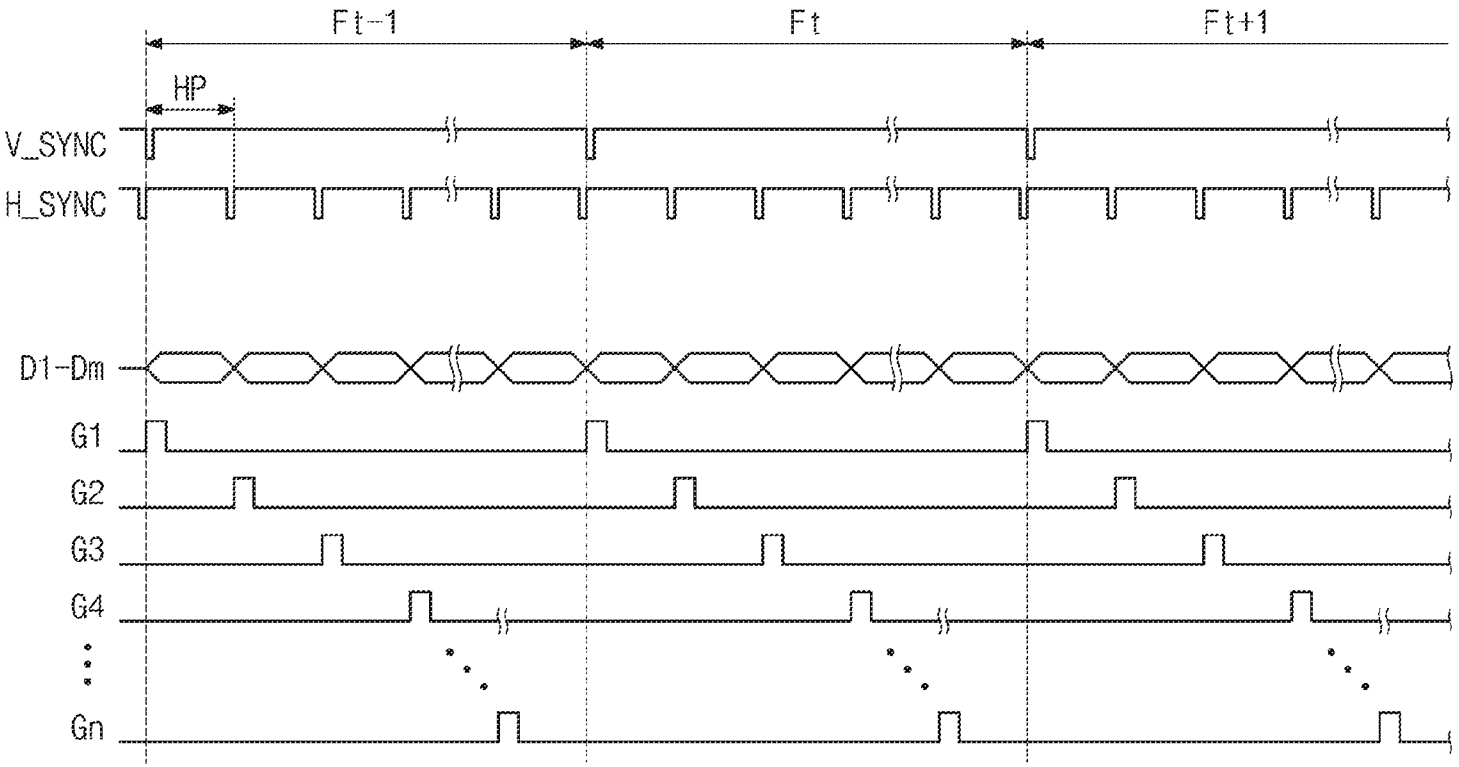
FIG. 2 is a timing diagram showing signals of the display device according to an exemplary embodiment of the present disclosure.

FIG. 1 is a plan view showing a display device according to an exemplary embodiment of the present disclosure, and FIG. 2 is a timing diagram showing signals of the display device according to an exemplary embodiment of the present disclosure.

Referring to FIGS. 1 and 2, the display device includes a display substrate DP, a gate driving circuit 110, data driving circuits 120 to 123, a driving controller 130, and a voltage generator 140.

The display substrate DP should not be particularly limited, for instance, the display substrate DP may include various display panels, such as a liquid crystal display panel, an organic light emitting display panel, an electrophoretic display panel, an electrowetting display panel, etc.

When viewed in a plan view, the display substrate DP includes a display area DA in which a plurality of pixels PX11 to PXnm is arranged and a non-display area NDA surrounding the display area DA.

The display substrate DS includes a plurality of gate lines GL1 to GLn and a plurality of data lines DL1 to DLm crossing the gate lines GL1 to GLn. The gate lines GL1 to GLn are connected to the gate driving circuit 110. The data lines DL1 to DLm are connected to a respective data driving circuit of the data driving circuits 120 to 123. In the present exemplary embodiment, each of the data driving circuits 120 to 123 is connected to y data lines, each of "y", "m", and "n" is a positive integer number, and the "m" is greater than "y" (m>y). In FIG. 1, some gate lines of the gate lines GL1 to GLn and some data lines of the data lines DL1 to DLm are shown.

In FIG. 1, some pixels of the pixels PX11 to PXnm are shown. Each of the pixels PX11 to PXnm is connected to a corresponding gate line of the gate lines GL1 to GLn and a corresponding data line of the data lines DL1 to DLm, respectively.

The pixels PX11 to PXnm are divided into a plurality of groups depending on a color displayed thereby. The pixels PX11 to PXnm may display one of primary colors. The primary colors may include a red color, a green color, a blue color, and a white color, but they should not be limited thereto or thereby. That is, the primary colors may further include a yellow color, a cyan color, a magenta color, etc.

The gate driving circuit 110 and the data driving circuits 120 to 123 receive a control signal from the driving controller 130. The driving controller 130 may be mounted on a main circuit board MCB. The driving controller 130 receives image data and a control signal from an external graphic controller (not shown). The control signal includes a vertical synchronization signal V_SYNC as a signal that distinguishes frame periods Ft−1, Ft, and Ft+1 from each other and a horizontal synchronization signal H_SYNC as a row distinction signal that distinguishes horizontal periods HP from each other. Although not shown in figures, the control signal may further include a data enable signal maintained at a high level during a period, in which data are output, to indicate a data input period and clock signals.

The gate driving circuit 110 generates gate signals G1 to Gn in response to the control signal received through a signal line GSL from the driving controller 130 during the frame periods Ft−1, Ft, and Ft+1 and outputs the gate signals G1 to Gn to the gate lines GL1 to GLn. The gate driving circuit 110 may be substantially simultaneously formed together with the pixels PX11 to PXnm through a thin film process. For instance, the gate driving circuit 110 may be mounted on the non-display area NDA in an oxide semiconductor TFT gate driver circuit (OSG). According to another embodiment, the gate driving circuit 110 may include a driving chip (not shown) and a flexible circuit board (not shown) on which the driving chip is mounted. In this case, the flexible circuit board may be electrically connected to the main circuit board MCB. According to another embodiment, the gate driving circuit 110 may be disposed in the non-display area NDA of the display substrate DP in a chip on glass (COG) manner.

FIG. 1 shows one gate driving circuit 110 connected to left ends of the gate lines GL1 to GLn as a representative example. According to another embodiment, the display device may include two gate driving circuits. In this case, one gate driving circuit of the two gate driving circuits may be connected to the left ends of the gate lines GL1 to GLn, and the other driving circuit of the two gate driving circuits may be connected to right ends of the gate lines GL1 to GLn. In addition, one gate driving circuit of the two gate driving circuits may be connected to odd-numbered gate lines, and the other gate driving circuit of the two gate driving circuits may be connected to even-numbered gate lines.

The data driving circuits 120 to 123 generate grayscale voltages corresponding to image data provided from the driving controller 130 in response to the control signal (hereinafter, referred to as a "data control signal") received from the driving controller 130. The data driving circuits 120 to 123 output the grayscale voltages to the data lines DL1 to DLm as data signals D1 to Dm.

The data signals D1 to Dm may include positive data signals having a positive value with respect to a common voltage and/or negative data signals having a negative value with respect to the common voltage. During each of the horizontal periods, some of the data signals may have the positive polarity and the other data signals may have the negative polarity. The polarity of the data signals may be inverted at every frame period in order to prevent liquid crystals from burning or deteriorating. The data driving circuits 120 to 123 may generate the data signals inverted every frame period in response to an inversion signal.

Each of the data driving circuits 120 to 123 may include a data driving chip 120*a* and a flexible circuit board 120*b* on which the data driving chip 120*a* is mounted. The flexible circuit board 120*b* electrically connects the main circuit board MCB to the display substrate DP. Each of the data driving chips 120*a* applies corresponding data signals to corresponding data lines of the data lines DL1 to DLm.

FIG. 1 shows the data driving circuits 120 to 123 in a chip-on-film (COF) manner as a representative example. According to another embodiment, the data driving circuits 120 to 123 may be disposed in the non-display area NDA of the display substrate DP in a chip-on-glass (COG) manner.

Each of the pixels PX11 to PXnm includes a thin film transistor and a liquid crystal capacitor. Each of the pixels PX11 to PXnm may further include a storage capacitor.

A pixel PXij is electrically connected to an i-th gate line GLi and a j-th data line DLj. The pixel PXij displays a pixel image corresponding to a data signal Dj received through the j-th data line DLj in response to a gate signal Gi received through the i-th gate line GLi.

The voltage generator 140 may generates various voltages required to operate the gate driving circuit 110, the data driving circuits 120 to 123, and the driving controller 130.

Figure 3:
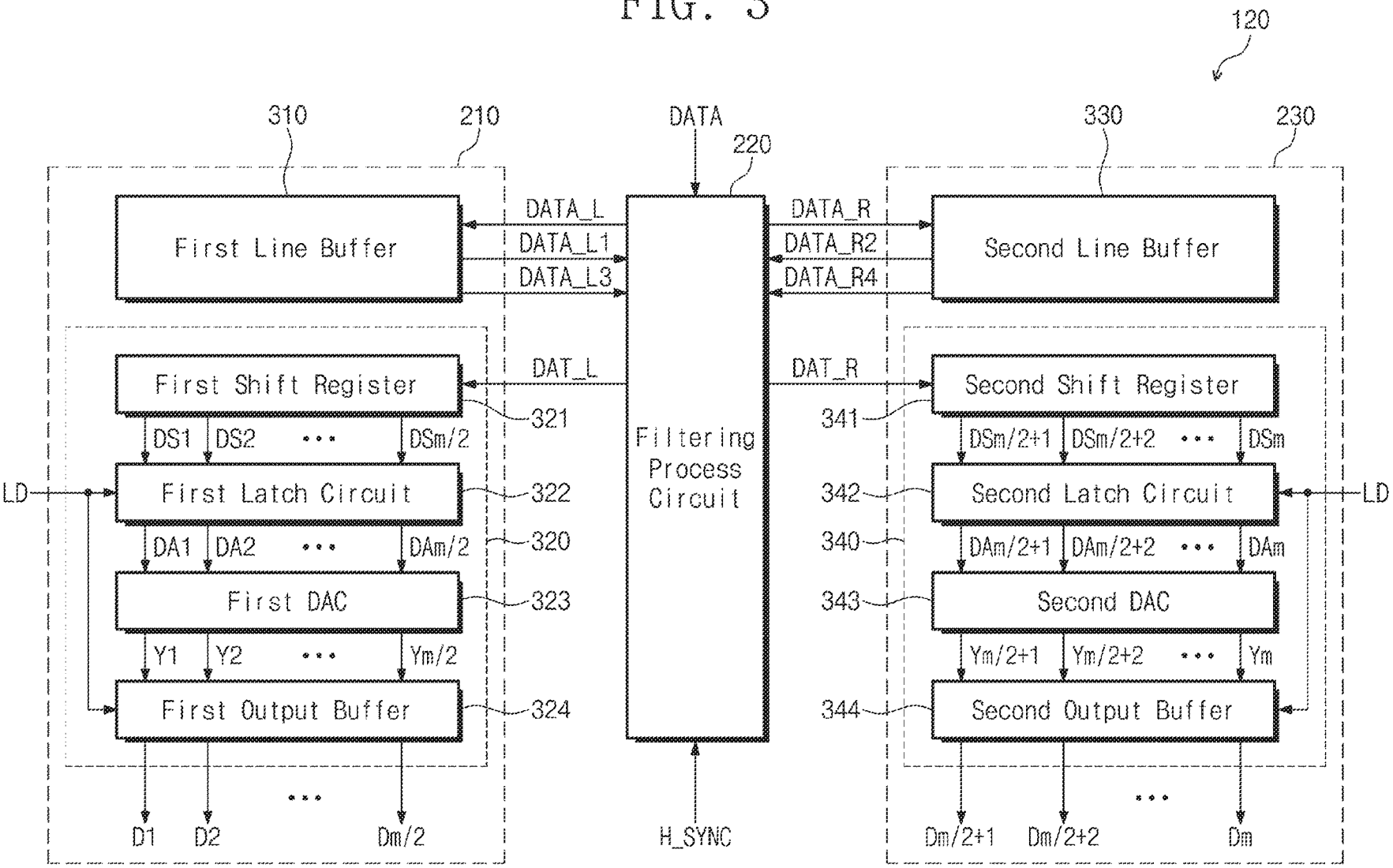
FIG. 3 is a block diagram showing a configuration of a data driving circuit according to an exemplary embodiment of the present disclosure.

FIG. 3 is a block diagram showing a configuration of the data driving circuit 120 according to an exemplary embodiment of the present disclosure.

Referring to FIG. 3, the data driving circuit 120 includes a first driving circuit 210, a filtering process circuit 220, and a second driving circuit 230. The first driving circuit 210 drives a first data line group (for example, first to (m/2)-th data lines DL1 to DLm/2) of the m data lines DL1 to DLm shown in FIG. 1. The second driving circuit 230 drives a second data line group (for example, ((m/2)+1)-th to m-th data lines DLm/2+1 to DLm) of the m data lines DL1 to DLm shown in FIG. 1.

The first driving circuit 210 includes a first line buffer 310 and a first output circuit 320. The first output circuit 320 includes a first shift register 321, a first latch circuit 322, a first digital-to-analog converter (a first DAC) 323, and a first output buffer 324.

The second driving circuit 230 includes a second line buffer 330 and a second output circuit 340. The second output circuit 330 includes a second shift register 341, a second latch 342, a second digital-to-analog converter (a second DAC) 343, and a second output buffer 344.

The filtering process circuit 220 alternately and sequentially outputs a present data signal DATA provided from the driving controller 130 shown in FIG. 1 as one of a first present data signal DATA_L and a second present data signal DATA_R. The first present data signal DATA_L is applied to the first line buffer 310, and the second present data signal DATA_R is applied to the second line buffer 330.

For instance, the present data signal DATA is provided to the first line buffer 310 as the first present data signal DATA_L during a first line period (e.g., odd-numbered data line periods in one frame), and the present data signal DATA is provided to the second line buffer 330 as the second present data signal DATA_R during a second line period (e.g., even-numbered data line periods in one frame).

The first line buffer 310 stores the first present data signal DATA_L and outputs a first previous line data signal DATA_L1 and a third previous line data signal DATA_L3. The second line buffer 330 stores the second present data signal DATA_R and outputs a second previous line data signal DATA_R2 and a fourth previous line data signal DATA_R4.

The filtering process circuit 220 outputs a first filtered data signal DAT_L and a second filtered data signal DAT_R on the basis of the present data signal DATA, the first previous line data signal DATA_L1, the second previous line data signal DATA_R2, the third previous line data signal DATA_L3, and the fourth previous line data signal DATA_R4. The first filtered data signal DAT_L is applied to the first output circuit 320, and the second filtered data signal DAT_R is applied to the second output circuit 340.

The first output circuit 320 converts the first filtered data signal DAT_L to the data signals D1 to Dm/2. The second output circuit 340 converts the second filtered data signal DAT_R to the data signals (Dm/2)+1 to Dm. The data signals D1 to Dm are provided to the data lines DL1 to DLm shown in FIG. 1.

Figure 4:
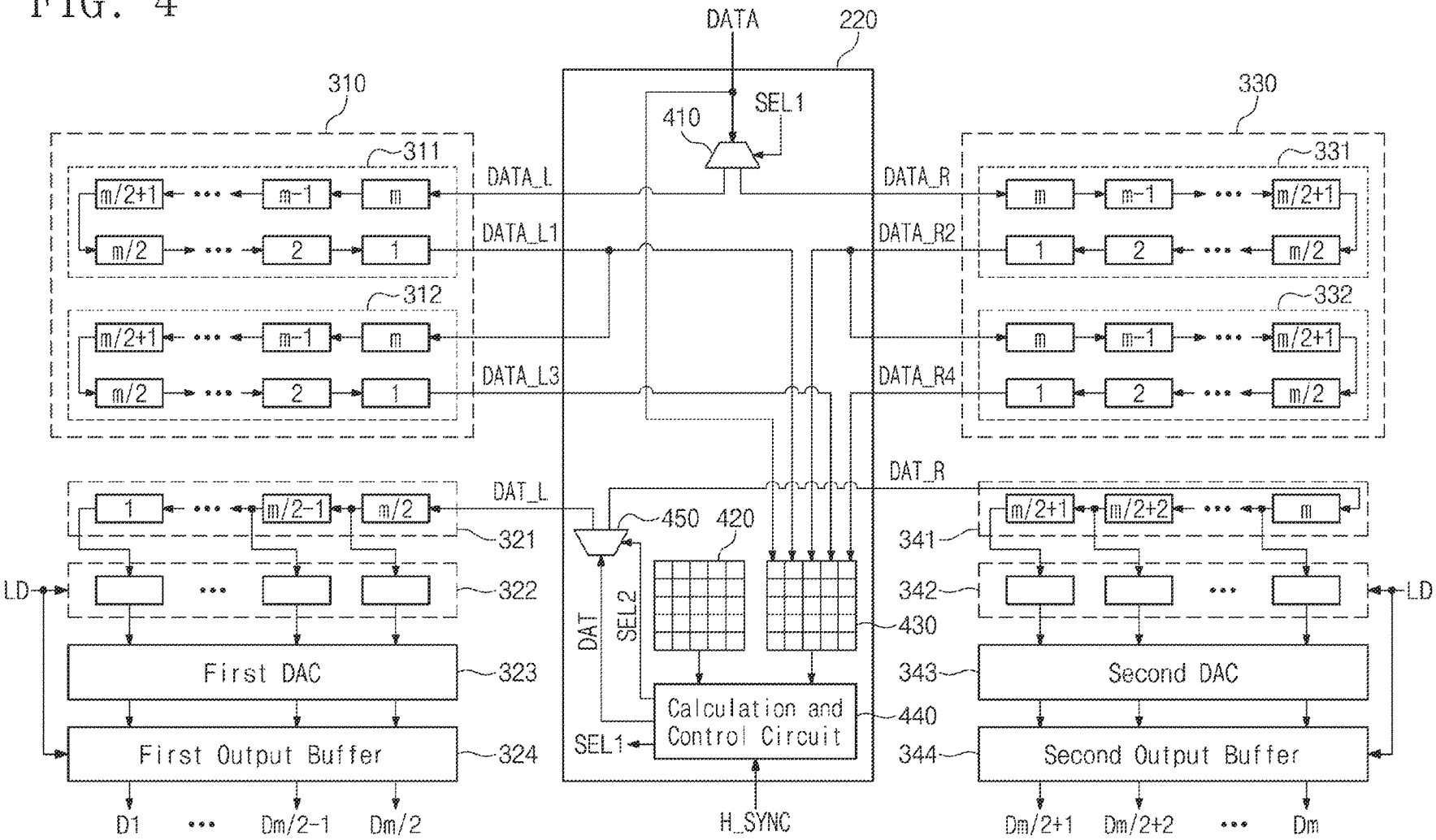
FIG. 4 is a block diagram showing examples of circuit configurations of a first driving circuit, a filtering process circuit, and a second driving circuit shown in FIG. 3.

FIG. 4 is a block diagram showing examples of circuit configurations of the first driving circuit, the filtering process circuit, and a second driving circuit shown in FIG. 3.

Referring to FIG. 4, the filtering process circuit 220 includes a first selection circuit 410. The first selection circuit 410 may be a demultiplexer. The first selection circuit 410 receives the present data signal DATA from the driving controller 130 and outputs the present data signal DATA as one of the first present data signal DATA_L and the second present data signal DATA_R in response to a first selection signal SEL1.

The first line buffer 310 includes a first shift circuit 311 and a third shift circuit 312. The first shift circuit 311 and the third shift circuit 312 may be embodied as first-in/first-out (FIFO) shift registers. The first shift circuit 311 may include m flip-flops that sequentially transmit the first present data signal DATA_L from the filtering process circuit 220. The third shift circuit 312 may include m flip-flops that sequentially transmit the first previous line data signal DATA_L1 from the first shift circuit 311. Although not shown in figures, each of the m flip-flops of the first shift circuit 311 and the m flip-flops of the third shift circuit 312 may be operated in synchronization with the clock signal.

The present data signal DATA is provided to the first shift circuit 311 as the first present data signal DATA_L through the first selection circuit 410 during a first line period. First to m-th first present data signals DATA_L respectively corresponding to m pixels in one row (e.g., PX11 to PX1*m*) of the display substrate DP shown in FIG. 1 are sequentially latched in the flip-flops of the first shift circuit 311. The numbers 1 to m written in the flip-flops of the first shift circuit 311 indicate a numerical order of the first present data signal DATA_L stored in each of the flip-flops when the m-th first present data signal DATA_L is applied to the first shift circuit 311.

The second line buffer 330 includes a second shift circuit 331 and a fourth shift circuit 332. The second shift circuit 331 and the fourth shift circuit 332 may be implemented as FIFO shift registers. The second shift circuit 331 may include a plurality of flip-flops that sequentially transmit the second present data signal DATA_R from the filtering process circuit 220. The fourth shift circuit 332 may include a plurality of flip-flops that sequentially transmit the second previous line data signal DATA_R2 from the second shift circuit 331. Although not shown in figures, each of the flip-flops of the second shift circuit 331 and the flip-flops of the fourth shift circuit 332 may be operated in synchronization with the clock signal.

The present data signal DATA is provided to the second shift circuit 331 as the second present data signal DATA_R through the first selection circuit 410 during a second line period following the first line period. The second present data signals DATA_R respectively corresponding to pixels in one row of the display substrate DP shown in FIG. 1 are sequentially latched in the flip-flops of the first shift circuit 331.

The first previous line data signal DATA_L1 output from the first shift circuit 311 is provided to the third shift circuit 312 during a third line period following the second line period. The first previous line data signals DATA_L1 respectively corresponding to the m pixels in one row of the display substrate DP are sequentially latched in the flip-flops of the third shift circuit 312. Meanwhile, the present data signal DATA is provided to the first shift circuit 311 as the first present data signal DATA_L through the first selection circuit 410 during the third line period. The first present data signals DATA_L respectively corresponding to the m pixels in one row of the display substrate DP are sequentially latched in the flip-flops of the first shift circuit 311.

The second previous line data signal DATA_R2 output from the second shift circuit 331 is provided to the fourth shift circuit 332 during a fourth line period following the third line period. The second previous line data signals respectively corresponding to the m pixels in one row of the display substrate DP are sequentially latched in the flip-flops of the fourth shift circuit 332. Meanwhile, the present data signal DATA is provided to the second shift circuit 331 as the second present data signal DATA_R through the first selection circuit 410 during the fourth line period. The second present data signals DATA_R respectively corresponding to the m pixels in one row of the display substrate DP are sequentially latched in the flip-flops of the second shift circuit 331.

The filtering process circuit 220 includes a first buffer 420, a second buffer 430, a calculation and control circuit 440, and a second selection circuit 450. The first buffer 420 stores a filtering coefficient. The second buffer 430 stores the present data signal DATA, the first previous line data signal DATA_L1 from the first shift circuit 311, the second previous line data signal DATA_R2 from the second shift circuit 331, the third previous line data signal DATA_L3 from the third shift circuit 312, and the fourth previous line data signal DATA_R4 from the fourth shift circuit 332.

In a case that the present data signal DATA is a data signal corresponding to a k-th data line, the first previous line data signal DATA_L1, the second previous line data signal DATA_R2, the third previous line data signal DATA_L3, and the fourth previous line data signal DARA_R4 are data signals respectively corresponding to a (k−1)th data line, a (k−2)th data line, a (k−3)th data line, and a (k−4)th data line.

Each of the first buffer 420 and the second buffer 430 may have a size corresponding to a 5 by 5 (5×5) kernel (or a window). The size of each of the first buffer 420 and the second buffer 430 may be determined depending on filtering operation characteristics (a kernel size) of the calculation and control circuit 440. For instance, the size of each of the first buffer 420 and the second buffer 430 may be variously changed to 3 by 3 (3×3), 7 by 7 (7×7), etc.

As an example, in a case that each of the first buffer 420 and the second buffer 430 has a size of 3×3, the first line buffer 310 may not include the third shift circuit 312 and may output only the first previous line data signal DATA_L1. In the case that each of the first buffer 420 and the second buffer 430 have the size of 3×3, the second line buffer 330 may not include the fourth shift circuit 332 and may output only the second previous line data signal DATA_R2.

As an example, in a case that each of the first buffer 420 and the second buffer 430 have a size of 7×7, the first line buffer 310 may further include a fifth shift circuit (not shown) and may further output a fifth previous line data signal (not shown). In the case that each of the first buffer 420 and the second buffer 430 have the size of 7×7, the second line buffer 330 may further include a sixth shift circuit (not shown) and may further output a sixth previous line data signal (not shown).

The calculation and control circuit 440 generates the first selection signal SEL1 and a second selection signal SEL2 in synchronization with the horizontal synchronization signal H_SYNC. The horizontal synchronization signal may be provided from the driving controller 130 shown in FIG. 1.

In addition, the calculation and control circuit 440 outputs a filtered data signal DAT obtained by calculating the filtering coefficient from the first buffer 420 and the data signal from the second buffer 430. For instance, the calculation and control circuit 440 may perform a convolution calculation on the filtering coefficient from the first buffer 420 and the data signal from the second buffer 430.

The second selection circuit 450 may be a demultiplexer. The second selection circuit 450 outputs the filtered data signal DAT as one of a first filtered data signal DAT_L and a second filtered data signal DAT_R in response to the second selection signal SEL2. For instance, the second selection circuit 450 outputs first to (m/2)th filtered data signals DAT in one line period as the first filtered data signal DAT_L and outputs ((m/2)+1)th to m-th filtered data signal DAT as the second filtered data signal DAT_R.

The first filtered data DAT_L is applied to the first shift register 321 of the first output circuit 320, and the second filtered data signal DAT_R is applied to second shift register 341 of the second output circuit 340.

The first shift register 321 may include m/2 flip-flops that sequentially transmit the first filtered data signal DAT_L from the filtering process circuit 220. Although not shown in figures, each of the m/2 flip-flops in the first shift register 321 may be operated in synchronization with the clock signal.

The second shift register 341 may include m/2 flip-flops that sequentially transmit the second filtered data signal DAT_R from the filtering process circuit 220. Although not shown in figures, the m/2 flip-flops in the second shift register 341 may be operated in synchronization with the clock signal.

Referring to FIG. 3 again, the first shift register 321 receives the first filtered data signal DAT_L and outputs shift data signals DS1 to DSm/2. The first latch circuit 322 substantially simultaneously provides the shift data signals DS1 to DSm/2 from the first shift register 321 to the first digital-to-analog converter 323 as analog data signals DA1 to DAm/2 in response to a load signal LD. The load signal LD may be provided from the driving controller 130 shown in FIG. 1.

The first DAC 323 converts the analog data signals DA1 to DAm/2 to latch data signals Y1 to Ym/2. The first output buffer 324 receives the latch data signals Y1 to Ym/2 and outputs the data signals D1 to Dm/2 to the data lines DL1 to DLm/2 shown in FIG. 1 in response to the load signal LD.

The second shift register 341 receives the second filtered data signal DAT_R and outputs shift data signals DSm/2+1 to DSm. The second latch circuit 342 substantially simultaneously provides the shift data signal (DSm/2)+1 to DSm from the second shift register 341 to the second DAC 343 as analog data signals (DAm/2)+1 to DAm in response to the load signal LD.

The second DAC 343 converts the analog data signals (DAm/2)+1 to DAm to latch data signals Ym/2+1 to Ym. The second output buffer 344 receives the latch data signals Ym/2+1 to Ym and outputs the data signals Dm/2+1 to Dm to the data lines DLm/2+1 to DLm shown in FIG. 1 in response to the load signal LD.

Figure 5:
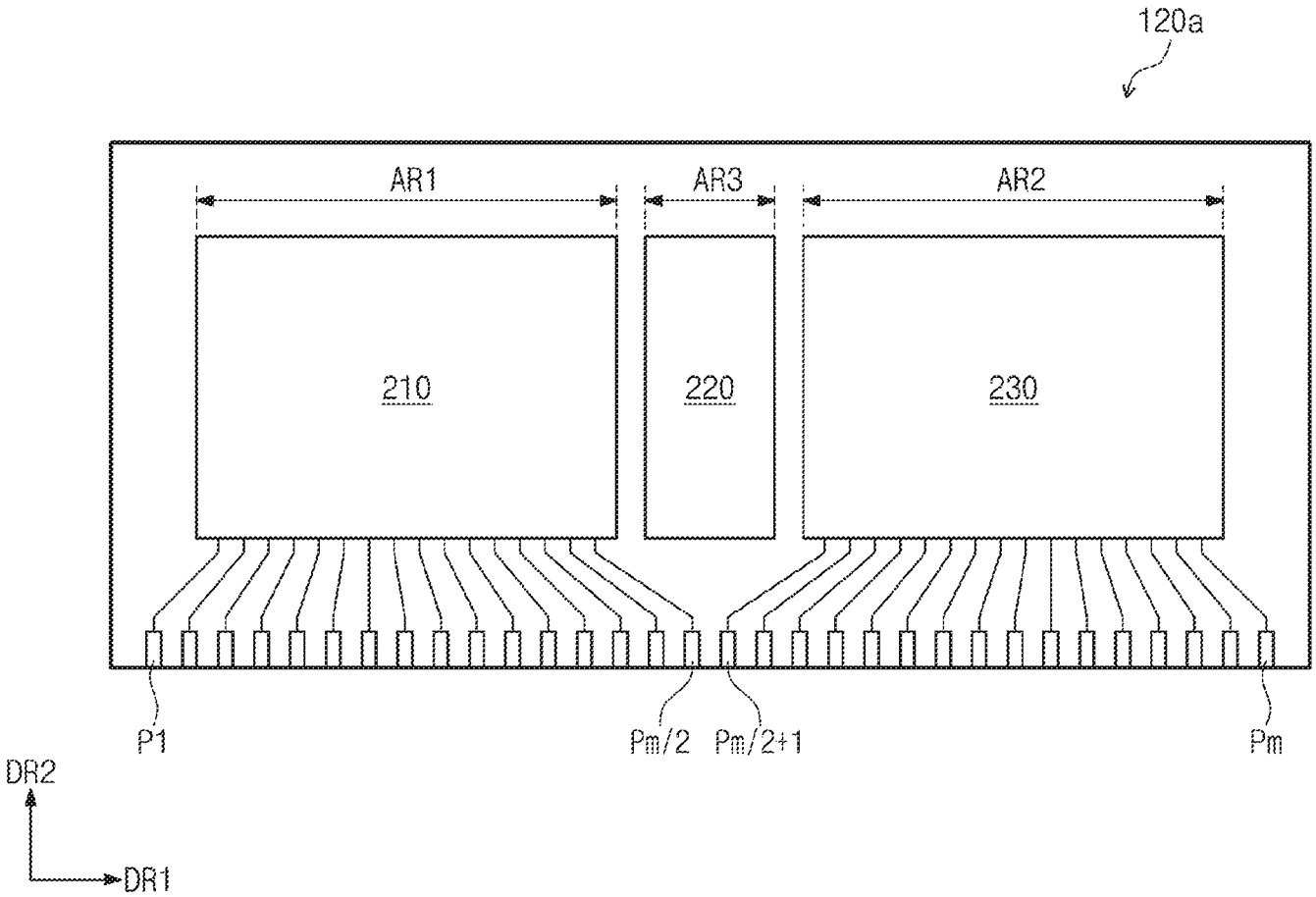
FIG. 5 is a view showing an arrangement of a first driving circuit, a filtering process circuit, and a second driving circuit of a data driving circuit according to an exemplary embodiment of the present disclosure.

FIG. 5 is a view showing an arrangement of the first driving circuit, the filtering process circuit, and the second driving circuit of the data driving chip according to an exemplary embodiment of the present disclosure.

Referring to FIG. 5, the data driving chip 120*a* includes the first driving circuit 210, the filtering process circuit 220, the second driving circuit 230, and a plurality of pads P1 to Pm. The pads P1 to Pm respectively correspond to the data lines DL1 to DLm shown in FIG. 1.

As shown in FIG. 3, the first driving circuit 210 includes the first line buffer 310 and the first output circuit 320. The first driving circuit 210 may be electrically connected to pads P1 to Pm/2 among the pads P1 to Pm.

As shown in FIG. 3, the second driving circuit 230 includes the second line buffer 330 and the second output circuit 340. The second driving circuit 230 may be electrically connected to pads (Pm/2)+1 to Pm among the pads P1 to Pm.

The first driving circuit 210 and the second driving circuit 230 are arranged in a first area AR1 and a second area AR2 of the data driving chip 120*a*, respectively. The filtering process circuit 220 is disposed in a third area AR3 between the first area AR1 and the second area AR2.

In general, a length (e.g., about 2.5 mm) in a first direction DR1 of the data driving chip 120*a* is longer than a length (e.g., about 1.5 mm) in a second direction DR2 of the data driving chip 120*a*. Since the filtering process circuit 220 is disposed between the first driving circuit 210 and the second driving circuit 230, the increase in the area of the data driving chip 120*a* due to the filtering process circuit 220 may be minimized.

As described above, the number of the shift circuits in the first line buffer 310 and the second line buffer 330 may be changed depending on the filtering operation characteristics (the kernel size) of the calculation and control circuit 440 of the filtering process circuit 220. Circuit configurations may be easily changed by modifying a layout in which the number of shift circuits in the first line buffer 310 and the second line buffer 330 increases or decreases in the second direction DR2.

Although the exemplary embodiments of the present inventive concept have been described, it is understood that the present inventive concept should not be limited to these exemplary embodiments but various changes and modifications can be made by one ordinary skilled in the art within the spirit and scope of the present inventive concept as hereinafter claimed.

What is claimed is:

1. A driving circuit comprising:

a first line buffer that stores a first present data signal and outputs a first previous line data signal;

a second line buffer that stores a second present data signal and outputs a second previous line data signal;

a filtering process circuit that receives a present data signal, alternately outputs the present data signal as one of the first present data signal and the second present data signal, and outputs a first filtered data signal and a second filtered data signal based on the present data signal, the first previous line data signal, and the second previous line data signal;

a first output circuit that receives the first filtered data signal and drives a first data line group of a plurality of data lines; and a second output circuit that receives the second filtered data signal and drives a second data line group of the plurality of data lines.

2. The driving circuit of claim 1, wherein the first line buffer and the first output circuit are arranged in a first area, the second line buffer and the second output circuit are arranged in a second area, and the filtering process circuit is arranged in a third area disposed between the first area and the second area.

3. The driving circuit of claim 1, wherein the filtering process circuit comprises a first selection circuit that applies the present data signal corresponding to an odd-numbered data line to the first output circuit as the first present data signal and applies the present data signal corresponding to an even-numbered data line to the second output circuit as the second present data signal.

4. The driving circuit of claim 3, wherein the first line buffer comprises:

a first shift circuit that stores the first present data signal and outputs the first previous line data signal; and a third shift circuit that stores the first previous line data signal and outputs a third previous line data signal.

5. The driving circuit of claim 4, wherein each of the first and third shift circuits comprises a first-in/first-out shift register.

6. The driving circuit of claim 4, wherein the second line buffer comprises:

a second shift circuit that stores the second present data and outputs the second previous line data signal; and a fourth shift circuit that stores the second previous line data signal and outputs a fourth previous line data signal.

7. The driving circuit of claim 6, wherein each of the second and fourth shift circuits comprises a first-in/first-out shift register.

8. The driving circuit of claim 7, wherein the filtering process circuit further comprises:

a first buffer that stores a filtering coefficient;

a second buffer that stores the present data signal and the first to fourth previous line data signals;

a calculation and control circuit that performs a convolution calculation on the filtering coefficient from the first buffer and data signals from the second buffer, and outputs a filtered data signal; and a second selection circuit that applies the filtered data signal corresponding to the odd-numbered data line to the first output circuit as the first filtered data signal and applies the filtered data signal corresponding to the even-numbered data line to the second output circuit as the second filtered data signal.

9. The driving circuit of claim 1, wherein the first output circuit comprises:

a first shift register that receives the first filtered data signal and outputs shift data signal;

a first latch circuit that outputs the shift data signal as a latch data signal in response to a load signal;

a first digital-to-analog converter that converts the latch data signal from the first latch circuit to analog image signal; and a first output buffer that outputs the analog image signal to the first data line group in synchronization with the load signal.

10. The driving circuit of claim 1, wherein the second output circuit comprises:

a second shift register that receives the second filtered data signal and outputs shift data signal;

a second latch circuit that outputs the shift data signal as a latch data signal in response a load signal;

a second digital-to-analog converter that converts the latch data signal from the second latch circuit to analog image signal; and a second output buffer that outputs the analog image signal to the second data line group in response to the load signal.

11. A display device comprising:

a display panel that comprises a plurality of pixels respectively connected to a plurality of gate lines and to a plurality of data lines;

a gate driving circuit that drives the plurality of gate lines;

a data driving circuit that drives the plurality of data lines; and a driving controller that controls the gate driving circuit and the data driving circuit in response to a control signal and an image input signal provided from an external source and outputs a present data signal corresponding to the image input signal and a horizontal synchronization signal, the data driving circuit comprising:

a filtering process circuit that receives the present data signal, alternately outputs the present data signal as one of a first present data signal and a second present data signal, and outputs a first filtered data signal and a second filtered data signal on the basis of the present data signal, a first previous line data signal, and a second previous line data signal;

a first driving circuit that receives the first present data signal and the first filtered data signal, outputs the first previous line data signal, and drives a first data line group of the plurality of data lines; and a second driving circuit that receives the second present data signal and the second filtered data signal, outputs the second previous line data signal, and drives a second data line group of the plurality of data lines.

12. The display device of claim 11, wherein the first driving circuit comprises:

a first line buffer that stores the first present data signal and outputs the first previous line data signal; and a first output circuit that receives the first filtered data signal and drives the first data line group.

13. The display device of claim 12, wherein the first line buffer comprises:

a first shift circuit that stores the first present data signal and outputs the first previous line data signal; and a third shift circuit that stores the first previous line data signal and outputs a third previous line data signal.

14. The display device of claim 13, wherein the second driving circuit comprises:

a second line buffer that stores the second present data signal and outputs the second previous line data signal; and a second output circuit that receives the second filtered data signal and drives the second data line group.

15. The display device of claim 14, wherein the second line buffer comprises:

a second shift circuit that stores the second present data signal and outputs the second previous line data signal; and a fourth shift circuit that stores the second previous line data signal and outputs a fourth previous line data signal.

16. The display device of claim 15, wherein the filtering process circuit comprises:

a first buffer that stores a filtering coefficient;

a second buffer that stores the present data signal and the first to fourth previous line data signals;

a calculation and control circuit that performs a convolution calculation on the filtering coefficient from the first buffer and data signals from the second buffer, and outputs a filtered data signal; and a second selection circuit that applies the filtered data signal corresponding to an odd-numbered data line to the first output circuit as the first filtered data signal and applies the filtered data signal corresponding to an even-numbered data line to the second output circuit as the second filtered data signal.

17. The display device of claim 14, wherein the second output circuit comprises:

a second shift register that receives the second filtered data signal and outputs shift data signal;

a second latch circuit that outputs the shift data signal as a latch data signal in response to a load signal;

a second digital-to-analog converter that converts the latch data signal from the second latch circuit to analog image signal; and a second output buffer that outputs the analog image signal to the second data line group in response to the load signal.

18. The display device of claim 12, wherein the first output circuit comprises:

a first shift register that receives the first filtered data signal and outputs shift data signal;

a first latch circuit that outputs the shift data signal as a latch data signal in response to a load signal;

a first digital-to-analog converter that converts the latch data signal from the first latch circuit to analog image signal; and a first output buffer that outputs the analog image signal to the first data line group in response to the load signal.

19. A driving circuit comprising:

a first shift circuit that stores a first present data signal and outputs a first previous line data signal;

a second shift circuit that stores a second present data signal and outputs a second previous line data signal;

a third shift circuit that stores the first previous line data signal and outputs a third previous line data signal;

a fourth shift circuit that stores the second previous line data signal and outputs a fourth previous line data signal;

a filtering process circuit that receives a present data signal, alternately outputs the present data signal as one of the first present data signal and the second present data signal, and outputs a first filtered data signal and a second filtered data signal on the basis of the present data signal and the first to fourth previous line data signals;

a first output circuit that receives the first filtered data signal and drives a first data line group of a plurality of data lines; and a second output circuit that receives the second filtered data signal and drives a second data line group of the plurality of data lines.

20. The driving circuit of claim 19, wherein the filtering process circuit further comprises:

a first buffer that stores a filtering coefficient;

a second buffer that stores the present data signal and the first to fourth previous line data signals;

a calculation and control circuit that performs a convolution calculation on the filtering coefficient from the first buffer, and data signals from the second buffer, and outputs a filtered data signal; and a second selection circuit that applies the filtered data signal corresponding to an odd-numbered data line to the first output circuit as the first filtered data signal and applies the filtered data signal corresponding to an even-numbered data line to the second output circuit as the second filtered data signal.

* * * * *